US011762310B2

(12) United States Patent
Kyotani

(10) Patent No.: US 11,762,310 B2
(45) Date of Patent: Sep. 19, 2023

(54) IMAGE FORMING APPARATUS THAT DETERMINES WHETHER CARTRIDGE CAN BE USED IN THE IMAGE FORMING APPARATUS

(71) Applicant: BROTHER KOGYO KABUSHIKI KAISHA, Nagoya (JP)

(72) Inventor: Tadao Kyotani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/158,433

(22) Filed: Jan. 26, 2021

(65) Prior Publication Data

US 2021/0240103 A1 Aug. 5, 2021

(30) Foreign Application Priority Data

Jan. 31, 2020 (JP) ..... 2020-015592

(51) Int. Cl.

| | |
|---|---|
| ***G03G 21/00*** | (2006.01) |
| ***G03G 15/08*** | (2006.01) |
| ***G03G 15/00*** | (2006.01) |
| ***G03G 21/18*** | (2006.01) |

(52) U.S. Cl.

CPC ..... *G03G 15/0863* (2013.01); *G03G 15/556* (2013.01); *G03G 21/1875* (2013.01); *G03G 21/1889* (2013.01); *G03G 21/1892* (2013.01); *G03G 15/0865* (2013.01); *G03G 2215/0697* (2013.01); *G03G 2221/1823* (2013.01)

(58) Field of Classification Search

CPC ..... G03G 15/0863; G03G 15/556; G03G 21/1875; G03G 21/1889; G03G 21/1892; G03G 2215/0697; G03G 2215/0695; G03G 2221/1663; G03G 2221/1823; G03G 15/553

USPC ..... 399/12, 25, 27, 262, 24, 31

See application file for complete search history.

(56) References Cited

U.S. PATENT DOCUMENTS

| | | | | |
|---|---|---|---|---|
| 5,283,597 | A * | 2/1994 | Yoshida | G03G 21/1892 347/225 |
| 6,658,219 | B1 * | 12/2003 | Ito | G03G 21/1889 399/24 |
| 2004/0101320 | A1 * | 5/2004 | Haramoto | G03G 15/55 399/12 |

(Continued)

*Primary Examiner* — Robert B Beatty

(74) *Attorney, Agent, or Firm* — Merchant & Gould P.C.

(57) ABSTRACT

An image forming apparatus includes an apparatus body, a cover, a cartridge, and a controller. The cartridge includes a second memory storing lifetime information indicating lifetime of the cartridge and identification information unique to the cartridge. In a case where the lifetime information indicates the initial value for the lifetime, the controller is configured to perform setting the cartridge to be usable in the image forming apparatus. In a case where the controller determines that the lifetime information does not indicate the initial value for the lifetime of the cartridge, the controller is configured to perform judging whether the identification information stored in the second memory matches a registration identification information stored in a first memory of the apparatus body. In a case where the identification information matches the registration identification information, the controller is configured to perform determining that the cartridge is usable for the image forming apparatus.

8 Claims, 4 Drawing Sheets

(56) References Cited

U.S. PATENT DOCUMENTS

| | | | | |
|---|---|---|---|---|
| 2004/0207865 | A1 | 10/2004 | Wachter et al. | |
| 2005/0265735 | A1* | 12/2005 | Kim | G03G 15/5091 399/80 |
| 2008/0240745 | A1* | 10/2008 | Hibino | G03G 15/553 399/24 |
| 2011/0260834 | A1* | 10/2011 | Chapman | G03G 15/553 340/10.1 |
| 2013/0135681 | A1* | 5/2013 | Hayakawa | G03G 21/1889 358/1.16 |
| 2014/0186061 | A1* | 7/2014 | Hayakawa | G03G 15/553 399/24 |
| 2018/0086091 | A1 | 3/2018 | Jeran | |
| 2019/0079425 | A1* | 3/2019 | Lin | G03G 21/1652 |
| 2019/0113872 | A1* | 4/2019 | Kanakubo | B33Y 40/00 |

* cited by examiner

IMAGE FORMING APPARATUS THAT DETERMINES WHETHER CARTRIDGE CAN BE USED IN THE IMAGE FORMING APPARATUS

CROSS REFERENCE TO RELATED APPLICATION

This application claims priority from Japanese Patent Application No. 2020-015592 filed Jan. 31, 2020. The entire content of the priority application is incorporated herein by reference.

TECHNICAL FIELD

The present invention relates to an image forming apparatus and a cartridge.

BACKGROUND

An image forming apparatus uses consumables or replaceable parts for performing image formation. An example of a consumable is a cartridge that accommodates toner or ink used for forming images on the image forming apparatus. A replaceable part is a cartridge that must be occasionally replaced as the image forming apparatus is used. An example of a replaceable part is a drum cartridge. A drum cartridge includes a photosensitive drum and should be replaced when the surface of the photosensitive drum becomes worn or otherwise degraded. Such consumables or replaceable parts can be replaced in the image forming apparatus.

A cartridge also includes memory for storing a residual quantity in the case of a consumable, or lifetime information in the case of a replaceable part. The image forming apparatus has a controller that updates the residual quantity or lifetime information stored in the memory of the cartridge as the cartridge is used for forming images. Further, by writing information related to the image forming apparatus in the memory of a cartridge, this information can be used to identify the image forming apparatus that can use the cartridge.

For example, prior art describes a memory provided in a cartridge. When the cartridge is mounted in a printer, the controller of the printer controls a memory controller in the cartridge to write a printer identifier to the cartridge memory. In the prior art, the printer controller also compares the printer identifier for the printer itself with the printer identifier stored in the cartridge memory and determines that the cartridge can be used when the identifiers match and that the cartridge cannot be used when the identifiers do not match.

SUMMARY

The technology described in the prior art requires a printer identifier to be written to a cartridge memory having a relatively small capacity. Consequently, a method that can avoid using the memory in a cartridge when determining whether the cartridge can be used in the printer would be preferable to a method of writing a printer identifier to the cartridge memory.

In view of the foregoing, it is an object of the present invention to determine whether a cartridge can be used in an image forming apparatus without writing new information to the cartridge memory.

According to one aspect, the disclosure provides an image forming apparatus including an apparatus body, a cover, a cartridge, and a controller. The apparatus body has an opening and includes a first memory. The cover is movable relative to the apparatus body between an open position where the opening is opened and a closed position where the opening is closed. The cartridge includes material or a part used for image-formation. The cartridge is detachably attachable to the apparatus body through the opening. The cartridge includes a second memory storing lifetime information indicating lifetime of the cartridge and identification information unique to the cartridge. The controller is configured to determine whether the cartridge is usable for the image forming apparatus. The controller is configured to perform judging whether power to the image forming apparatus is turned on or the cover is changed from the open position to the closed position. When the controller determines that the power to the image forming apparatus is turned on or the cover is changed from the open position to the closed position, the controller is configured to perform judging whether the lifetime information acquired from the second memory of the cartridge indicates an initial value for the lifetime of the cartridge. In a case where the lifetime information indicates the initial value for the lifetime of the cartridge, the controller is configured to perform setting the cartridge to be usable in the image forming apparatus. In a case where the controller determines that the lifetime information does not indicate the initial value for the lifetime of the cartridge, the controller is configured to perform judging whether the identification information stored in the second memory matches a registration identification information stored in the first memory. In a case where the identification information matches the registration identification information, the controller is configured to perform determining that the cartridge is usable for the image forming apparatus. In a case where the identification information does not match the registration identification information, the controller configured to perform determining that the cartridge is not usable for the image forming apparatus.

According to another aspect, the disclosure provides a non-transitory storage medium storing a set of program instructions installed on and executed by a controller for controlling an image forming apparatus. The image forming apparatus includes an apparatus body, a cover, a cartridge, and the controller. The apparatus body has an opening and includes a first memory. The cover is movable relative to the apparatus body between an open position where the opening is opened and a closed position where the opening is closed. The cartridge includes material or a part used for image-formation. The cartridge is detachably attachable to the apparatus body through the opening. The cartridge includes a second memory storing lifetime information indicating lifetime of the cartridge and identification information unique to the cartridge. The controller is configured to determine whether the cartridge is usable for the image forming apparatus. The set of program instructions including: judging whether power to the image forming apparatus is turned on or the cover is changed from the open position to the closed position; when the controller determines that the power to the image forming apparatus is turned on or the cover is changed from the open position to the closed position, judging whether the lifetime information acquired from the second memory of the cartridge indicates an initial value for the lifetime of the cartridge; in a case where the lifetime information indicates the initial value for the lifetime of the cartridge, setting the cartridge to be usable in the image forming apparatus; in a case where the controller determines that the lifetime information does not indicate the initial value for the lifetime of the cartridge, judging whether the identification information stored in the second memory matches a registration identification information stored in the first memory; in a case where the identification information matches the registration identification information, determining that the cartridge is usable for the image forming apparatus; and in a case where the identification information does not match the registration identification information, determining that the cartridge is not usable for the image forming apparatus.

According to still another aspect, the disclosure provides an image-forming control method controlling an image forming apparatus. The image forming apparatus includes an apparatus body, a cover, a cartridge and a controller. The apparatus body has an opening and includes a first memory. The cover is movable relative to the apparatus body between an open position where the opening is opened and a closed position where the opening is closed. The cartridge includes material or a part used for image-formation. The cartridge is detachably attachable to the apparatus body through the opening. The cartridge includes a second memory storing lifetime information indicating lifetime of the cartridge and identification information unique to the cartridge. The controller is configured to determine whether the cartridge is usable for the image forming apparatus. The controller is configured to perform judging whether power to the image forming apparatus is turned on or the cover is changed from the open position to the closed position. When the controller determines that the power to the image forming apparatus is turned on or the cover is changed from the open position to the closed position, the controller is configured to perform judging whether the lifetime information acquired from the second memory of the cartridge indicates an initial value for the lifetime of the cartridge. In a case where the lifetime information indicates the initial value for the lifetime of the cartridge, the controller is configured to perform setting the cartridge to be usable in the image forming apparatus. In a case where the controller determines that the lifetime information does not indicate the initial value for the lifetime of the cartridge, the controller is configured to perform judging whether the identification information stored in the second memory matches a registration identification information stored in the first memory. In a case where the identification information matches the registration identification information, the controller is configured to perform determining that the cartridge is usable for the image forming apparatus. In a case where the identification information does not match the registration identification information, the controller is configured to perform determining that the cartridge is not usable for the image forming apparatus.

According to still another aspect, the disclosure provides a cartridge including a cartridge body and a memory. The cartridge body includes a material or a part used for image-formation. The memory stores lifetime information indicating lifetime of the cartridge and identification information unique to the cartridge. It is determined whether the cartridge can be used for an image forming apparatus based on the identification information and depending on a result of judging whether the lifetime information indicates an initial value for the lifetime of the cartridge.

BRIEF DESCRIPTION OF THE DRAWINGS

The particular features and advantages of the disclosure will become apparent from the following description taken in connection with the accompanying drawings, in which.

DETAILED DESCRIPTION

Next, an embodiment of the present invention will be described while referring to the accompanying drawings. In the following description, a direction extending along the rotational axis of a developing roller in a toner cartridge will be called the "first direction."

Figure 1:
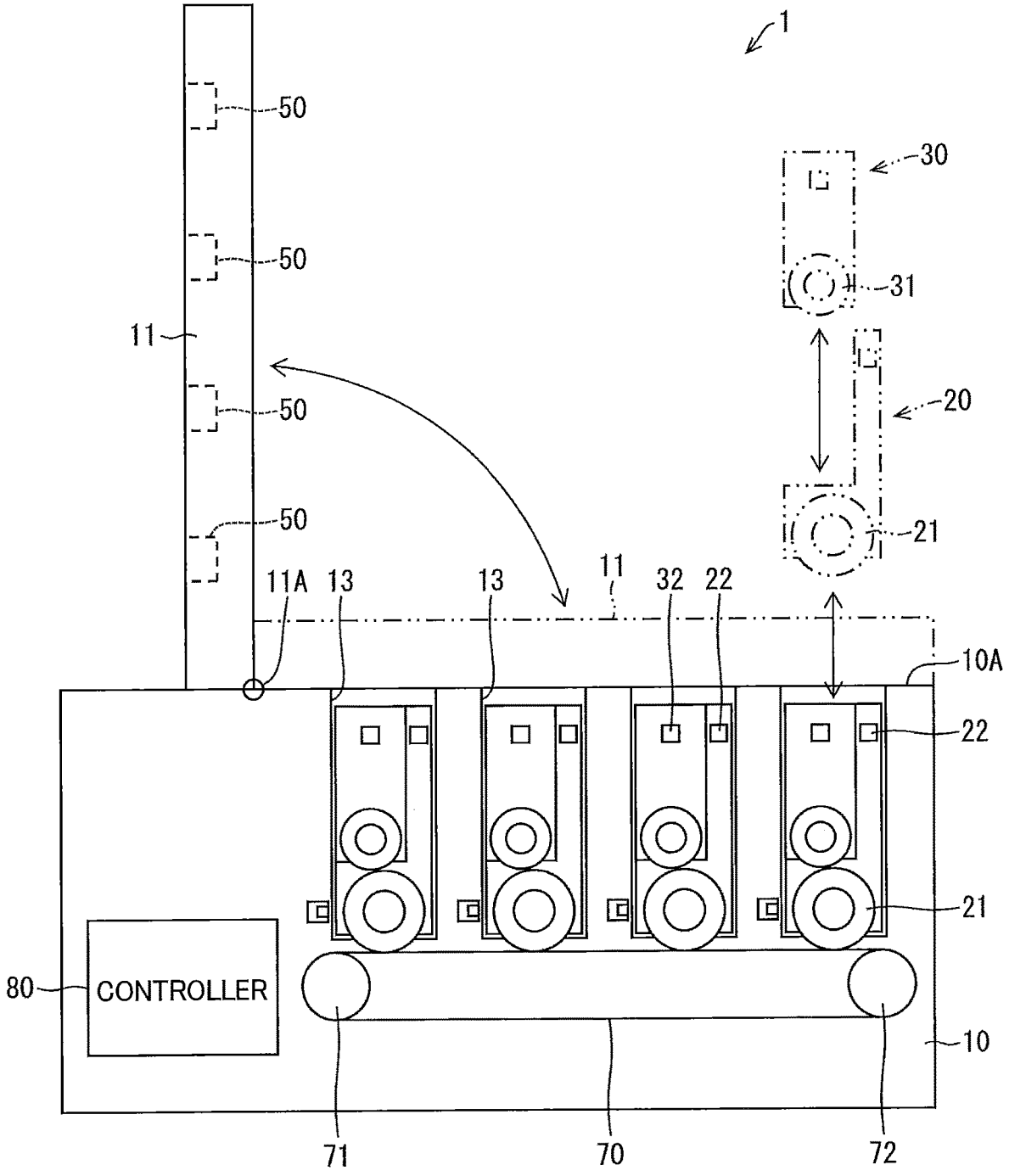
FIG. 1 is a conceptual diagram illustrating an image forming apparatus according to one embodiment of the present disclosure.
Figure 2:
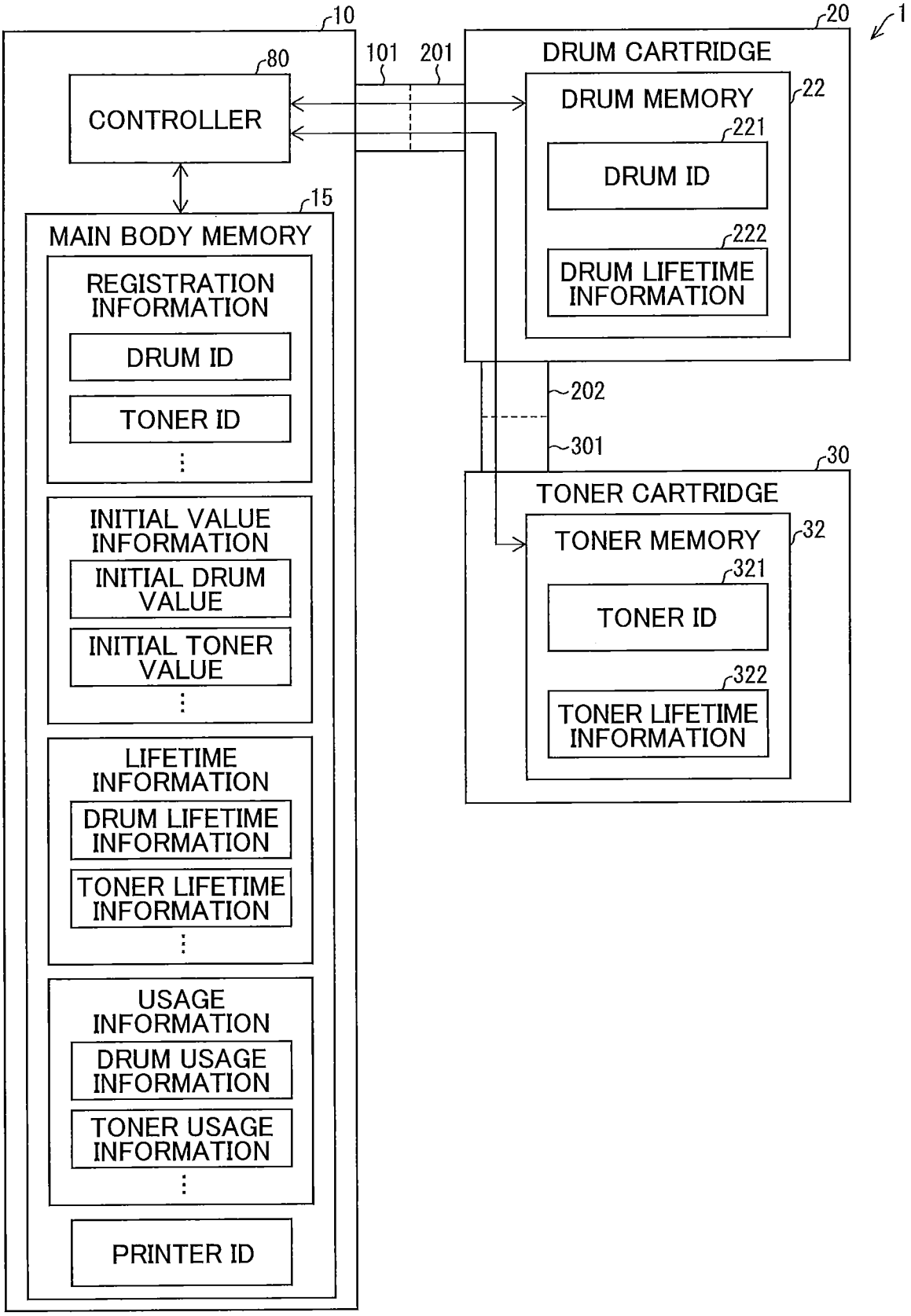
FIG. 2 is a block diagram illustrating a mounting of drum cartridges and toner cartridge in a main casing of the image forming apparatus.

FIG. 1 is a schematic diagram of an image forming apparatus 1. FIG. 2 is a block diagram illustrating the mounting of drum cartridges 20 and toner cartridges 30 in a main casing 10 of the image forming apparatus 1. The image forming apparatus 1 is an electrophotographic printer. An LED printer is one example of the image forming apparatus 1.

As shown in FIGS. 1 and 2, the image forming apparatus 1 includes the main casing 10, a cover 11, drum cartridges 20 as an example of cartridges, toner cartridges 30 as an example of the cartridges, a transfer belt 70, and a controller 80. Four each of the drum cartridges 20 and toner cartridges 30 are mountable in the image forming apparatus 1. That is, four drum cartridges 20 and four toner cartridges 30 are mountable in the image forming apparatus 1. The image forming apparatus 1 also includes four light source units 50 having a one-on-one correspondence with the drum cartridges 20 and toner cartridges 30.

Each toner cartridge 30 is mounted in the corresponding drum cartridge 20. Each drum cartridge 20 in which the corresponding toner cartridge 30 is mounted is mounted in the image forming apparatus 1.

The main casing 10 has a rectangular box shape. The four drum cartridges 20, four toner cartridges 30, transfer belt 70, and controller 80 are accommodated in the main casing 10. The main casing 10 has four cartridge retaining units 13. Each cartridge retaining unit 13 has a recess that is open in the main casing 10. The drum cartridges 20 and toner cartridges 30 are retained in corresponding cartridge retaining units 13 when mounted in the main casing 10.

A liquid crystal display, indicators such as lamps, and input units such as buttons are provided on the outer surface of the main casing 10. The liquid crystal display may also be configured with a touchscreen that functions as an input unit.

An opening 10A is formed in the top surface of the main casing 10. The cover 11 is disposed so as to open and close over the opening 10A by rotating (moving) about a rotational shaft 11A that extends along the first direction. The cover 11 can rotate between an open position for exposing the opening 10A, as depicted with solid lines in FIG. 1, and a closed position for covering the opening 10A, as depicted with two-dot chain lines in FIG. 1. The openings of the cartridge retaining units 13 are exposed in the opening 10A when the cover 11 is in the open position and are covered by the cover 11 when the cover 11 is in the closed position.

A cover sensor not shown in the drawings is provided in the opening 10A of the main casing 10. The cover sensor detects when the cover 11 is in the closed position. The cover sensor may be a contact-type sensor or an optical sensor, for example.

Each drum cartridge 20 has a cartridge case (not shown) that is mountable in the main casing 10. The cartridge case includes a photosensitive drum 21 as a part used for forming images. The photosensitive drum 21 is a replaceable part. As the photosensitive drum 21 is used, the surface of the photosensitive drum 21 wears or otherwise degrades, requiring the photosensitive drum 21 to be replaced. The photosensitive drum 21 is a cylindrical photosensitive member extending in the first direction. The photosensitive drum 21 can rotate about a drum shaft extending in the first direction. The outer circumferential surface of the photosensitive drum 21 is covered by a photosensitive material.

The drum cartridge 20 also has a drum memory 22 as an example of a second memory. The drum memory 22 allows the reading and writing of information. For example, the drum memory 22 may be flash ROM (read-only memory) or EEPROM (registered trademark; electrically erasable programmable read-only memory).

The drum memory 22 has a first area 221 and a second area 222, both of which are for storing information related to the photosensitive drum 21 of the drum cartridge 20. The first area 221 stores a drum ID as an example of identification information. The second area 222 stores drum lifetime (life) information as an example of lifetime information.

The drum ID is a unique serial number for identifying an individual drum cartridge 20. The drum lifetime information is at least one of a cumulative number of rotations of the photosensitive drum 21 and a cumulative number of pages printed using the photosensitive drum 21, for example.

The cumulative number of rotations of the photosensitive drum 21 is calculated by incrementing or decrementing the initial number in the drum cartridge 20 identified by the ID each time the drum cartridge 20 is used in printing. The cumulative number of pages printed using the photosensitive drum 21 is calculated by incrementing or decrementing the initial value stored in the drum cartridge 20 identified by the drum ID each time the drum cartridge 20 is used in printing.

In addition to the drum ID and drum lifetime information, the drum memory 22 may store models of the image forming apparatus in which the drum cartridge 20 can be used, specifications of the drum cartridge 20, information indicating whether the drum cartridge 20 is a new product, information indicating whether the drum cartridge 20 is a genuine product, the error history of the drum cartridge 20, and the like.

Each toner cartridge 30 has a developing roller 31, and a cartridge case (not shown) that can accommodate toner or other developer as an example of printing material. The cartridge case is mountable in the main casing 10. The four toner cartridges 30 accommodate developer in different colors (for example, the colors cyan, magenta, yellow, and black). This developer is the material used for forming images. The developer is a consumable that becomes depleted during use. The developing roller 31 is a cylindrical member that extends along the first direction and is rotatable about a developing shaft extending in the first direction. When the toner cartridge 30 is mounted in the drum cartridge 20, the outer circumferential surface of the photosensitive drum 21 contacts the outer circumferential surface of the developing roller 31.

The toner cartridge 30 also has a toner memory 32 as an example of the second memory. The toner memory 32 is disposed at the outer surface of the toner cartridge 30 at one end in the first direction. The toner memory 32 allows reading and writing of information. For example, the toner memory 32 may be flash ROM or EEPROM (registered trademark).

The toner memory 32 has a first area 321 and a second area 322, both of which are for storing information related to the toner cartridge 30. The first area 321 stores a toner ID as an example of the identification information. The second area 322 stores toner lifetime (life) information as an example of the lifetime information. Data in the second area 322 may be rewritten a plurality of times.

The toner ID is a unique serial number for identifying an individual toner cartridge 30, for example. The toner lifetime information is at least one of a cumulative number of rotations of the developing roller 31, a cumulative number of pages printed using the developing roller 31, and a cumulative number of dots formed using the developing roller 31, for example.

The cumulative number of rotations of the developing roller 31 is calculated by incrementing or decrementing an initial value stored for the toner cartridge identified by the toner ID each time the developing roller 31 is used for printing. The cumulative number of pages printed using the developing roller 31 is calculated by incrementing or decrementing an initial value stored for the toner cartridge 30 identified by the toner ID each time the developing roller 31 is used for printing. The cumulative number of dots formed using the developing roller 31 is calculated by incrementing or decrementing an initial value for the toner cartridge 30 identified by the toner ID each time the developing roller 31 is used for printing.

As shown in FIG. 1, the drum cartridges 20 and toner cartridges 30 are mounted in the main casing 10 while the cover 11 is in its open position. In this state, the drum cartridges 20 and toner cartridges 30 are inserted through the opening 10A into the corresponding cartridge retaining units 13.

The main casing 10 also has connectors 101. Each drum cartridge 20 has a connector 201 that can connect to one of the connectors 101. When the drum cartridge 20 is inserted into the cartridge retaining unit 13, the connection formed between the connector 101 and connector 201 enables the controller 80 of the main casing 10 to exchange data with the drum memory 22 of the drum cartridge 20.

Each drum cartridge 20 also has a connector 202. Each toner cartridge 30 has a connector 301 that can be connected to the connector 202 of the corresponding drum cartridge 20. The connector 201 and connector 202 are connected via wiring (not shown) provided in the drum cartridge 20. When the toner cartridge 30 is mounted in the drum cartridge 20, the connection formed between the connector 202 and connector 301 enables the controller 80 of the main casing 10 to exchange data with the toner memory 32 of the toner cartridge 30.

The four light source units 50 are mounted on the inner surface of the cover 11. The light source units 50 are arranged at positions on the cover 11 for confronting the top surfaces of corresponding photosensitive drums 21 when the drum cartridges 20 are mounted in the main casing 10 and the cover 11 is placed in its closed position. Each light source unit 50 has a plurality of light sources aligned in the first direction. The light sources can irradiate light onto the outer circumferential surface of the corresponding photosensitive drum 21. The light sources may be light emitting diodes (LEDs), for example.

Each light source unit 50 is electrically connected to the controller 80. The controller 80 controls the light sources of each light source unit 50 to emit light based on inputted image data. In response to this control, the light sources irradiate light toward the outer circumferential surface of the corresponding photosensitive drum 21, exposing the photosensitive material on the outer circumferential surface of the photosensitive drum 21 according to the image data.

The transfer belt 70 is also a part used for forming images. The transfer belt 70 is a replaceable part. As the transfer belt 70 is used, the surface of the transfer belt 70 becomes worn or otherwise degrades, requiring the transfer belt 70 to be replaced. The transfer belt 70 is a belt having an annular shape (an endless belt) that can contact each of the photosensitive drums 21. In other words, the outer circumferential surfaces of the photosensitive drums 21 can contact the outer surface of the transfer belt 70. During a printing process, printing paper is conveyed between the transfer belt 70 and the photosensitive drums 21.

The transfer belt 70 is stretched around a drive roller 71 and a follow roller 72. The drive roller 71 drives the transfer belt 70 to circulate, and the follow roller 72 rotates along with the transfer belt 70 that is circulated by the drive of the drive roller 71. The controller 80 controls the drive roller 71 to rotate.

The controller 80 has an application-specific integrated circuit (ASIC), for example. The controller 80 is electrically connected to an apparatus body memory 15 provided in the main casing 10. The apparatus body memory 15 is an example of a first memory. The controller 80 executes various processes such as a printing process and various related processes on the image forming apparatus 1.

The controller 80 may also include a processor, such as a CPU. In this case, a control program for implementing a control method for image formation may be saved in the apparatus body memory 15. The processor executes operations according to the control program so that the controller 80 can control the image forming apparatus 1 to perform a printing process.

The controller 80 may also include a computer-readable storage medium that stores the control program. Here, the storage medium may be a "non-transitory, tangible medium," such as ROM, a tape, a disc, a card, semiconductor memory, or a programmable logic circuit. Random-access memory (RAM) may also be used for developing the control program. The control program may also be supplied to the computer described above via any transmission medium (a communication network, broadcast waves, etc.) capable of transmitting the control program. Note that one aspect of this specification is that the control program can be implemented in the form of data signals embedded in a carrier wave, as embodied in electronic transmission.

When the drum cartridge 20 and toner cartridge 30 are mounted in the corresponding cartridge retaining unit 13 of the main casing 10, the drum memory 22 and toner memory 32 are electrically connected to the controller 80, as illustrated in FIG. 2. Consequently, the controller 80 can execute a process to read information from the drum memory 22 and toner memory 32 and a process to write information (including a rewriting process) to the drum memory 22 and toner memory 32.

The apparatus body memory 15 allows the reading and writing of information. The apparatus body memory 15 is flash ROM or EEPROM (registered trademark), for example. The apparatus body memory 15 stores registration information, initial value information, lifetime information, and usage information.

Registration information includes the drum ID read from the drum memory 22, and the toner ID read from the toner memory 32. The initial value information includes information specifying the initial drum value and information specifying the initial toner value. The initial drum value information includes a prescribed value representing the initial value for the lifetime of the drum cartridge 20. The initial toner value information is a prescribed value representing the initial value for the lifetime of the toner cartridge 30.

The lifetime information includes drum lifetime information and toner lifetime information. The drum lifetime information is identical to the drum lifetime information stored in the drum memory 22, e.g., at least one of the cumulative number of rotations of the photosensitive drum 21 and the cumulative number of pages printed using the photosensitive drum 21. The toner lifetime information is identical to the toner lifetime information stored in the toner memory 32, e.g., at least one of the cumulative number of rotations of the developing roller 31, the cumulative number of pages printed using the developing roller 31, and the cumulative number of dots formed using the developing roller 31.

The usage information includes drum usage information and toner usage information. The drum usage information indicates whether the drum cartridge 20 can be used and is represented by one of the values "usable (unused)," "usable (in use)," and "unusable." "Usable (unused)" signifies that the drum cartridge 20 can be used on the image forming apparatus 1 and has not yet been used. "Usable (in use)" indicates that the drum cartridge 20 can be used on the image forming apparatus 1 and is used but has remaining lifetime. "Unusable" indicates that the drum cartridge 20 is used and reaches the end of operational lifetime. The toner usage information indicates whether the toner cartridge 30 is usable and has one of the values "usable (unused)," "usable (in use)," and "unusable."

The apparatus body memory 15 may also store a printer ID. The printer ID is identification information, such as a serial number, for identifying an individual image forming apparatus.

Figure 3:
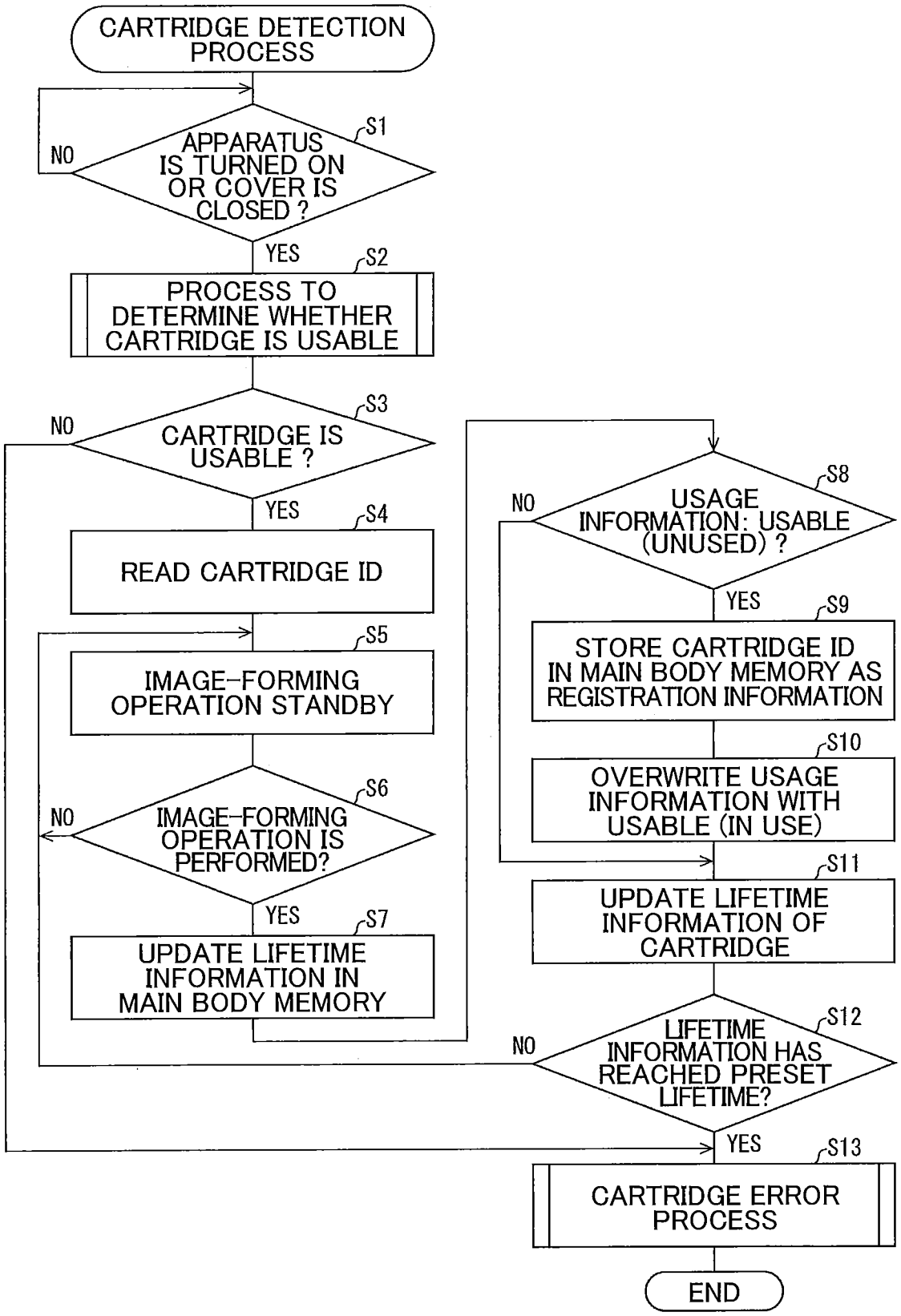
FIG. 3 is a flowchart illustrating steps in a cartridge detection process executed by a controller of the image forming apparatus.

Next, a process performed on the image forming apparatus 1 for detecting drum cartridges 20 and toner cartridges 30 will be described. FIG. 3 is a flowchart illustrating steps in the cartridge detection process executed by the controller 80 of the image forming apparatus 1.

The detection process in the following description is performed when at least one of the drum cartridges 20 and toner cartridges 30 is replaced. When not specified, the drum cartridge 20 or toner cartridge 30 will simply be referred to as "the cartridge." Similarly, when the drum cartridge 20 or toner cartridge 30 is not specified, the drum memory 22 or toner memory 32 of the corresponding drum cartridge 20 or toner cartridge 30 will simply be referred to as "the memory."

In S1 of FIG. 3, the controller 80 first determines whether the power to the image forming apparatus 1 was turned on or, based on output from the cover sensor described above, whether the cover 11 is moved from the open position exposing the opening 10A to the closed position (first determination process).

Power to the image forming apparatus 1 being turned on does not necessarily indicate that a cartridge is replaced. However, because a cartridge may be replaced while the power to the image forming apparatus 1 is turned off, a new cartridge may be attached when the power to the image forming apparatus 1 is turned back on. Accordingly, the controller 80 recognizes that a cartridge is replaced when the power is turned on. Further, because the cover 11 is always opened and closed when a cartridge is replaced, the controller 80 recognizes that a cartridge is replaced when the position of the cover 11 changes from the open position to the closed position.

Thus, the controller 80 waits in S1 until determining that the power to the image forming apparatus 1 is in the on state or that the cover is in the closed state (S1: NO). When determining that the power supply is in the on state or the cover is in the closed state (S1: YES), in S2 the controller 80 performs a process to determine whether the cartridge can be used, i.e., whether the usage information in the cartridge is "usable (unused)," "usable (in use)," or "unusable." The process to determine whether a cartridge is usable is executed as a subroutine and will be described later.

In S3 the controller 80 determines based on the results of the process of S2 whether the usage information in the cartridge is usable. Specifically, in S3 the controller 80 determines based on the results of the process of S2 whether the usage information in the cartridge is "usable (unused)" or "usable (in use)". In a case where the controller 80 determines in S3 that the usage information in the cartridge is usable (S3: YES), in S4 the controller 80 reads the ID from the memory of the cartridge. That is, in S4 the controller 80 reads the drum ID from the drum memory 22 and the toner ID from the toner memory 32. The controller 80 temporarily stores these IDs in registers provided in the controller 80.

In S5 the controller 80 waits until the image forming apparatus 1 is ready to perform an image-forming operation. In this idle state, the controller 80 waits to receive a print request inputted on the input units described above or inputted externally and monitors rotating operations of the photosensitive drums 21 and the transfer belt 70 during warm-up (warm-up operations). Upon receiving a print request, the controller 80 issues instructions to the toner cartridges 30 to supply toner.

In S6 the controller 80 determines whether any image-forming operation is performed during this wait state. The controller 80 determines in S6 that image-forming operation is performed in a case where a print request is received or in a case where a warm-up operation is detected. In a case where the controller 80 determines in S6 that no image-forming operation is performed (S6: NO), the controller 80 returns to S5.

In a case where the controller 80 determines in S6 that image-forming operation is performed (S6: YES), in S7 the controller 80 updates the lifetime information in the apparatus body memory 15 (updating process). Note that the controller 80 has acquired this lifetime information from the memories of the cartridges and stored the information in the apparatus body memory 15 in advance. The controller 80 may perform this process to store lifetime information while performing the process to read IDs in S4, for example.

In S8 the controller 80 determines whether the usage information in the cartridge is "usable (unused)." The controller 80 determines whether the usage information is "usable (unused)" based on the usage information stored in the apparatus body memory 15.

In a case where the controller 80 determines in S8 that the usage information for the cartridge is "usable (unused)," in S9 the controller 80 stores the temporarily saved ID for the cartridge in the apparatus body memory 15 as a registration ID (second storage process). The registration ID is an example of the registration identification information.

In S10 the controller 80 overwrites the usage information "usable (unused)" stored in the apparatus body memory 15 with "usable (in use)" (rewriting process). In S11 the controller 80 updates the lifetime information on the cartridge to match the lifetime information stored in the apparatus body memory 15 (first storage process). In other words, in S11 the controller 80 writes the lifetime information updated in the apparatus body memory 15 to the memory of the cartridge.

In S12 the controller 80 determines whether the lifetime information stored in the apparatus body memory 15 reaches a preset lifetime. That is, in S12 the controller 80 compares the lifetime information with a lifetime value preset in the apparatus body memory 15 or the like and determines that the lifetime information reaches the preset lifetime when the lifetime information is greater than or equal to this preset lifetime value. The lifetime value for a drum cartridge 20 is defined as a number of rotations of the photosensitive drum 21 or a number of pages printed with the photosensitive drum 21, for example. The lifetime value for a toner cartridge 30 is defined as a number of pages printed with the toner cartridge 30 or a number of dots formed with the toner cartridge 30, for example.

In a case where the controller 80 determines in S12 that the lifetime information reaches the preset lifetime (S12: YES), in S13 the controller 80 executes a cartridge error process and subsequently ends the cartridge detection process. In the cartridge error process, the controller 80 notifies the user that the cartridge can no longer be used because the cartridge reaches the end of operational lifetime.

On the other hand, in a case where the controller 80 determines in S3 that the usage information for the cartridge is not usable, i.e., is "unusable" (S3: NO), the controller 80 advances to S13 described above. Further, in a case where the controller 80 determines in S8 that the usage information is not "usable (unused)", but is "usable (in use)" (S8: NO), the controller 80 advances to S1*l* described above. Further, in a case where the controller 80 determines in S12 that the lifetime information does not reach the preset lifetime (S12: NO), the controller 80 returns to S5 described above.

Figure 4:
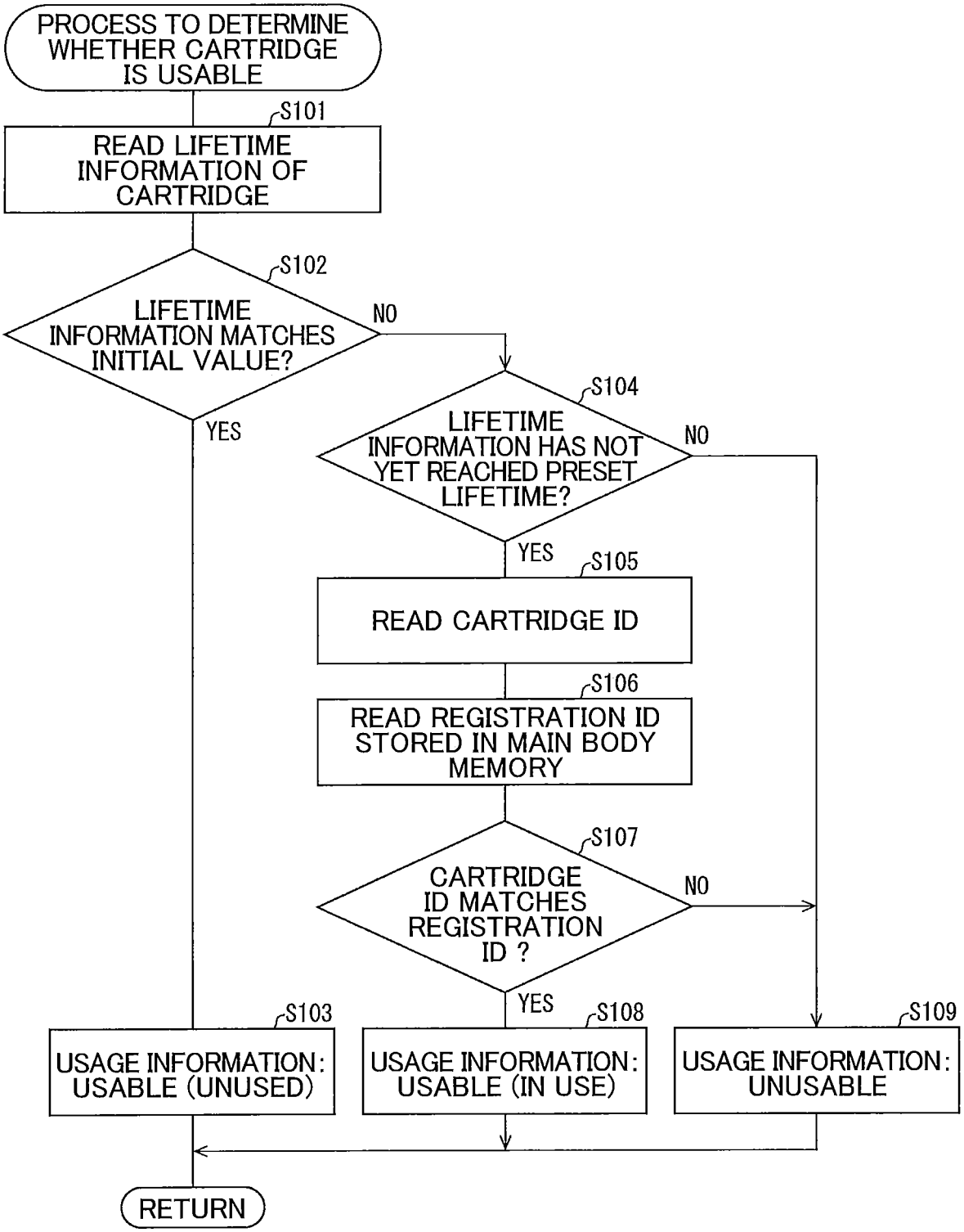
FIG. 4 is a flowchart illustrating steps in a process to determine whether a cartridge is usable executed by the controller in the cartridge detection process.

Next, the process of S2 to determine whether a cartridge is usable will be described. FIG. 4 is a flowchart illustrating steps in the process to determine whether a cartridge is usable executed by the controller 80 in the cartridge detection process of FIG. 3.

In S101 of FIG. 4, the controller 80 reads lifetime information from the memory of the cartridge. In S102 the controller 80 determines whether the lifetime information acquired from the memory of the cartridge indicates the initial value for cartridge lifetime (second determination process). Specifically, in S102 the controller 80 compares the lifetime information acquired from the memory of the cartridge to initial value information stored in the apparatus body memory 15 and determines that the lifetime information indicates the initial value for the cartridge lifetime when the lifetime information matches the initial value.

In a case where the controller 80 determines in S102 that the lifetime information indicates the initial value for cartridge lifetime (S102: YES), in S103 the controller 80 determines that the usage information stored in the apparatus body memory 15 should be "usable (unused)." In S103 the controller 80 sets the usage information to "usable (unused)" by setting a flag in the apparatus body memory 15 for "usable (unused)" to ON (setting process), and subsequently returns to the main routine shown in FIG. 3.

However, in a case where the controller 80 determines in S102 that the lifetime information does not indicate the initial value for cartridge lifetime (S102: NO), in S104 the controller 80 determines whether the lifetime information does not yet reach the end of operational lifetime (fourth determination process). Specifically, the controller 80 determines in S104 whether the lifetime information reaches the end of operational lifetime by comparing the lifetime information with the same lifetime value described above in S12.

In a case where the controller 80 determines in S104 that the lifetime information does not yet reach the end of operational lifetime (S104: YES), in S105 the controller 80 reads the ID from the memory of the cartridge. In S106 the controller 80 reads the registration ID stored in the apparatus body memory 15.

In S107 the controller 80 determines whether the cartridge ID read in S105 matches the registration ID read in S106 (third determination process). In a case where the controller 80 determines in S107 that the cartridge ID matches the registration ID (S107: YES), in S108 the controller 80 determines that the usage information in the apparatus body memory 15 should be "usable (in use)." That is, in S108 the controller 80 sets the usage information from "usable (unused)" to "usable (in use)" by setting a flag in the apparatus body memory 15 for "usable (in use)" to ON, and subsequently returns to the main routine in FIG. 3.

However, in a case where the controller 80 determines in S107 that the cartridge ID does not match the registration ID (S107: NO) or in a case where the controller 80 determines in S104 that the lifetime information reaches the end of operational lifetime (S104: NO), in S109 the controller 80 determines that the cartridge cannot be used and sets the usage information in the apparatus body memory 15 to "unusable" Specifically, in S109 the controller 80 sets the usable information to "unusable" by setting a flag in the apparatus body memory 15 for "unusable" to ON, and subsequently returns to the main routine in FIG. 3.

As described above, the controller 80 in the image forming apparatus 1 according to the embodiment executes the first determination process, second determination process, third determination process, and first storage process. When a new cartridge is mounted for the first time in the main casing 10 of the image forming apparatus 1 having this configuration, the controller 80 stores the cartridge ID as a registration ID in the apparatus body memory 15 after determining that lifetime information for the lifetime of the cartridge indicates the initial value for the cartridge lifetime. In this way, the controller 80 can manage each cartridge.

In a case where the controller 80 determines that the lifetime information for the lifetime of the cartridge does not indicate the initial value of the cartridge lifetime, the controller 80 determines that the cartridge can be used if determining in the third determination process that the cartridge ID matches a registration ID in the apparatus body memory 15. On the other hand, in a case where the controller 80 determines in the third determination process that the cartridge ID does not match the registration ID in the apparatus body memory 15, the controller 80 determines that the cartridge cannot be used. Through this process, the controller 80 can prevent the image forming apparatus 1 from using a cartridge having an ID that is not registered in the apparatus body memory 15.

The controller 80 can determine whether a cartridge is usable based on lifetime information that is generally provided in cartridges. The controller 80 does not need any new information for determining whether a cartridge can be used. Therefore, the image forming apparatus 1 can determine whether a cartridge is usable without writing new information to the memory of the cartridge, eliminating the need for additional capacity in the cartridge memory to store such new information.

The controller 80 updates lifetime information on the apparatus body memory 15 through the updating process described above, and subsequently stores the updated information in the memory of the cartridge through the second storage process. Thus, lifetime information updated in the apparatus body memory 15 in response to image-forming operations is also updated in the memory of the cartridge, thereby ensuring that the lifetime information in both memories match.

The controller 80 executes the rewriting process described above and executes the second storage process when executing the rewriting process. Accordingly, lifetime information in the cartridge is updated in a case where usage information for the cartridge is changed from "unused" to "in use" in response to an unused cartridge being used. Therefore, the image forming apparatus 1 can avoid updating lifetime information without having determined whether the cartridge is unused.

The controller 80 also executes the third determination process after determining in the fourth determination process that the cartridge does not reach the end of operational lifetime. In this way, the controller 80 can determine that the cartridge does not reach the end of operational lifetime based on lifetime information and can perform the third determination process while the cartridge is still in a usable state.

When it is determined that the lifetime information stored in the memory of a cartridge does not indicate the initial value for the lifetime of the cartridge, the controller 80 determines whether the cartridge can be used in the image forming apparatus 1 based on the cartridge ID. Accordingly, the controller 80 can determine whether a cartridge is usable based on the cartridge ID.

Next, a variation of the embodiment will be described. The cartridges mounted in the image forming apparatus 1 described above are the drum cartridges 20 and toner cartridges 30. However, the transfer belt 70 may also be configured as a cartridge that can be mounted in the image forming apparatus 1. A transfer belt 70 with this configuration also possesses a memory similar to the drum memory 22. This memory stores an ID for the transfer belt 70, and lifetime information for the transfer belt 70. The lifetime information for the transfer belt 70 is at least one of the number of circulations of the transfer belt 70 and the number of pages printed using the transfer belt 70.

The controller 80 determines whether the cartridge including the transfer belt 70 can be used in the image forming apparatus 1 by performing the same process described in FIGS. 3 and 4 for the drum cartridges 20 and toner cartridges 30.

While the image forming apparatus 1 described in the embodiment is an electrophotographic printer, the present invention may also be applied to an inkjet printer. When the invention is applied to an inkjet printer, the cartridges are ink cartridges that supply ink. Alternatively, a tape cassette that supplies tape as the printing material may serve as the cartridge.

The structures of the drum cartridge 20 and toner cartridge 30 are not limited to those described in the embodiment. For example, the developing roller 31 may be provided in the drum cartridge 20 rather than the toner cartridge 30. Alternatively, the toner cartridge 30, a developing device (the developing roller 31), and the drum cartridge 20 may all be provided separately. Further, the drum cartridge 20 and toner cartridge 30 may be configured as an integral cartridge.

While the description has been made in detail with reference to the embodiments thereof, it would be apparent to those skilled in the art that many modifications and variations may be made therein without departing from the spirit of the disclosure.

What is claimed is:

1. An image forming apparatus comprising:

an apparatus body having an opening and comprising a first memory;

a cover movable relative to the apparatus body between an open position where the opening is opened and a closed position where the opening is closed;

a cartridge including material or a part used for image-formation, the cartridge being detachably attachable to the apparatus body through the opening, the cartridge comprising a second memory storing lifetime information indicating lifetime of the cartridge and identification information unique to the cartridge; and a controller configured to determine whether the cartridge is usable for the image forming apparatus, the controller being configured to perform:

judging whether power to the image forming apparatus is turned on or the cover is changed from the open position to the closed position;

when the controller determines that the power to the image forming apparatus is turned on or the cover is changed from the open position to the closed position, judging whether the lifetime information acquired from the second memory of the cartridge indicates an initial value for the lifetime of the cartridge;

in a case where the lifetime information indicates the initial value for the lifetime of the cartridge, setting the cartridge to be usable in the image forming apparatus;

in a case where the controller determines that the lifetime information does not indicate the initial value for the lifetime of the cartridge, judging whether the identification information stored in the second memory matches a registration identification information stored in the first memory;

in a case where the identification information matches the registration identification information, determining that the cartridge is usable for the image forming apparatus; and in a case where the identification information does not match the registration identification information, determining that the cartridge is not usable for the image forming apparatus.

2. The image forming apparatus according to claim 1, wherein the first memory stores therein data of the initial value for the lifetime of the cartridge, and wherein the controller compares the lifetime information acquired from the second memory of the cartridge to the initial value stored in the first memory, and determines that the lifetime information indicates the initial value for the lifetime of the cartridge when the lifetime information matches the initial value.

3. The image forming apparatus according to claim 1, wherein the controller stores the lifetime information acquired from the second memory to the first memory, the controller being configured to further perform:

updating the lifetime information stored in the first memory in accordance with execution of an image-forming operation; and storing the updated lifetime information in the second memory.

4. The image forming apparatus according to claim 1, wherein the first memory stores usage information indicating which of an unused state, an in use state, and an unusable state the cartridge is in, and wherein, in a case where the controller determines that the lifetime information acquired from the second memory indicates the initial value for the lifetime of the cartridge, the controller sets the cartridge to be usable for the image forming apparatus, and the cartridge is used for an image-formation operation, the controller performs:

rewriting the usage information for the cartridge from the unused state to the in use state; and storing the identification information of the cartridge in the first memory as the registration information.

5. The image forming apparatus according to claim 1, wherein, in a case where the controller determines that the lifetime information acquired from the second memory of the cartridge does not indicate the initial value for the lifetime of the cartridge, the controller performs:

determining whether the lifetime of the cartridge reaches an end of the lifetime of the cartridge based on the lifetime information stored in the second memory; and in a case where the controller determines that the lifetime of the cartridge does not reach the end of the lifetime of the cartridge, judging whether the identification information stored in the second memory matches the registration identification information stored in the first memory.

6. The image forming apparatus according to claim 1, wherein the cartridge is either one of a toner cartridge capable of accommodating toner therein and a drum cartridge comprising a photosensitive drum.

7. A non-transitory storage medium storing a set of program instructions installed on and executed by a controller for controlling an image forming apparatus, the image forming apparatus comprising:

an apparatus body having an opening and comprising a first memory;

a cover movable relative to the apparatus body between an open position where the opening is opened and a closed position where the opening is closed;

a cartridge including material or a part used for image-formation, the cartridge being detachably attachable to the apparatus body through the opening, the cartridge comprising a second memory storing lifetime information indicating lifetime of the cartridge and identification information unique to the cartridge; and the controller configured to determine whether the cartridge is usable for the image forming apparatus, the set of program instructions comprising:

judging whether power to the image forming apparatus is turned on or the cover is changed from the open position to the closed position;

when the controller determines that the power to the image forming apparatus is turned on or the cover is changed from the open position to the closed position, judging whether the lifetime information acquired from the second memory of the cartridge indicates an initial value for the lifetime of the cartridge;

in a case where the lifetime information indicates the initial value for the lifetime of the cartridge, setting the cartridge to be usable in the image forming apparatus;

in a case where the controller determines that the lifetime information does not indicate the initial value for the lifetime of the cartridge, judging whether the identification information stored in the second memory matches a registration identification information stored in the first memory;

in a case where the identification information matches the registration identification information, determining that the cartridge is usable for the image forming apparatus; and in a case where the identification information does not match the registration identification information, determining that the cartridge is not usable for the image forming apparatus.

8. An image-forming control method controlling an image forming apparatus, the image forming apparatus comprising:

an apparatus body having an opening and comprising a first memory;

a cover movable relative to the apparatus body between an open position where the opening is opened and a closed position where the opening is closed;

a cartridge including material or a part used for image-formation, the cartridge being detachably attachable to the apparatus body through the opening, the cartridge comprising a second memory storing lifetime information indicating lifetime of the cartridge and identification information unique to the cartridge; and a controller configured to determine whether the cartridge is usable for the image forming apparatus, the controller being configured to perform:

judging whether power to the image forming apparatus is turned on or the cover is changed from the open position to the closed position;

when the controller determines that the power to the image forming apparatus is turned on or the cover is changed from the open position to the closed position, judging whether the lifetime information acquired from the second memory of the cartridge indicates an initial value for the lifetime of the cartridge;

in a case where the lifetime information indicates the initial value for the lifetime of the cartridge, setting the cartridge to be usable in the image forming apparatus;

in a case where the controller determines that the lifetime information does not indicate the initial value for the lifetime of the cartridge, judging whether the identification information stored in the second memory matches a registration identification information stored in the first memory;

in a case where the identification information matches the registration identification information, determining that the cartridge is usable for the image forming apparatus; and in a case where the identification information does not match the registration identification information, determining that the cartridge is not usable for the image forming apparatus.

* * * * *